United States Patent [19]

Von Kohorn

[11] Patent Number: 4,924,361

[45] Date of Patent: May 8, 1990

[54] SYSTEM FOR GLARE-FREE ILLUMINATION IN WET LOCATIONS

[76] Inventor: Henry Von Kohorn, 945 Treasure Lane, Vero Beach, Fla. 32963

[21] Appl. No.: 343,060

[22] Filed: Apr. 25, 1989

[51] Int. Cl.[5] ..... F21V 33/00

[52] U.S. Cl. ..... 362/96; 362/101

[58] Field of Search ..... 362/96, 101, 326, 806

[56] References Cited

U.S. PATENT DOCUMENTS

| | | | |
|---|---|---|---|
| 1,533,738 | 4/1925 | Kane et al. | 362/96 X |
| 1,728,456 | 9/1929 | Stuerue | 362/96 X |
| 2,226,915 | 12/1940 | Trowbridge | 362/96 X |
| 2,572,379 | 10/1951 | Pearse | 362/96 X |
| 4,088,880 | 5/1978 | Walsh | 362/96 |
| 4,594,646 | 6/1986 | Von Kohorn et al. | 362/101 |
| 4,616,304 | 10/1986 | Von Kohorn | 362/101 |
| 4,626,968 | 12/1986 | Von Kohorn | 362/122 |
| 4,630,177 | 12/1986 | Von Kohorn et al. | 362/32 |
| 4,672,513 | 6/1987 | Von Kohorn et al. | 362/32 |
| 4,686,611 | 8/1987 | Von Kohorn | 362/123 |
| 4,725,930 | 2/1988 | Von Kohorn | 362/145 |
| 4,729,069 | 3/1988 | Von Kohorn et al. | 362/32 |
| 4,758,934 | 7/1988 | Von Kohorn | 362/145 |

FOREIGN PATENT DOCUMENTS

| | | | |
|---|---|---|---|
| 424862 | 4/1925 | Fed. Rep. of Germany | 362/96 |
| 184451 | 10/1955 | Sweden | 362/101 |

*Primary Examiner*—Ira S. Lazarus
*Assistant Examiner*—Peggy A. Neils
*Attorney, Agent, or Firm*—Perman & Green

[57] ABSTRACT

A system for the concurrent upward passage of light and downward passage of water has an outer drainage receptacle for water and an inner waterproof receptacle for a light source. A transparent watertight lid protects the light source and conducts water falling on the system into the outer drainage receptacle, which may also serve as a recirculation tank for water of a fountain. A structure formed of light and water conducting members is positioned above the transparent lid, confining upwardly projected light to a plurality of light cones not visible by observers grouped around the system and visible only by the light reflections from an object to be illuminated and positioned above said light and water conducting members.

7 Claims, 2 Drawing Sheets

SYSTEM FOR GLARE-FREE ILLUMINATION IN WET LOCATIONS

The present invention relates to an apparatus and system for the illumination of three-dimensional objects in wet locations and more particularly to the uniform and glare-free illumination of such objects without the disadvantages normally associated with spot lights, track lights, ceiling lights and flood lights. The system according to the present invention is particularly useful in outdoor locations and for uses in which water falls or, or is directed at, illuminated objects.

It therefore is an object of the present invention to provide a cost-effective system for glare-free illumination in wet locations, requiring a short light path and obviating spot lights and other light sources irritating to the eyes of observers.

It is another object of the invention to provide an integrated reservoir to hold water running downwardly through the apparatus and to serve as a recirculation receptacle for spray means, while concurrently permitting light generated in the apparatus to shine upwardly.

It is yet another object of the invention to prevent scattering of light and to shield the eyes of observers from the light source of the apparatus by confining the light to an upwardly spreading light cone enveloping an object to be illuminated positioned above the apparatus, said light not being directly visible to observers stationed outside said light cone.

SUMMARY OF THE INVENTION

A system is provided which permits the concurrent upward passage of light projected by a light source in the apparatus against an object to be illuminated and the downward passage of water falling on the apparatus, such water being collected in a reservoir without contacting the light source.

These capabilities are achieved by providing an outer receptacle adapted to collect and drain off water and an inner receptacle insulated from water and adapted to contain a light source. A waterproof lid is provided above the receptacle for the light source and a structure comprised of a plurality of grouped, hollow, vertically extending, light conducting members is provided above said lid, said member having co-terminal upper edges forming a table-like perforate surface. Said surface may be adapted to support the object to be illuminated above and in close proximity to the light source, resulting in a short light path, reduced lamp size and power requirements. The light conducting members permit the upward passage of light in the shape of a plurality of light cones not directly visible by persons grouped around the system. Water falling on the system is collected in said outer receptacle and may either be drained off or used in the recirculation of water sprayed into the space above the system.

DETAILED DESCRIPTION OF DRAWINGS AND OF THE INVENTION

The system according to the present invention comprises an illuminating apparatus capable of supporting an object to be illuminated, watertight means to protect a light source disposed below and in close proximity to said object and means to drain away water falling on the apparatus. When desired, the system includes means for spraying water or other liquids in a fountain-like manner, liquid circulating means and a liquid reservoir for the recirculation of such sprayed liquid.

The apparatus used in the system may have any desired configuration, including a cross-sectional top plan configuration which has round or straight sides, and may also have a combination of straight and free-form sides.

Figure 1:
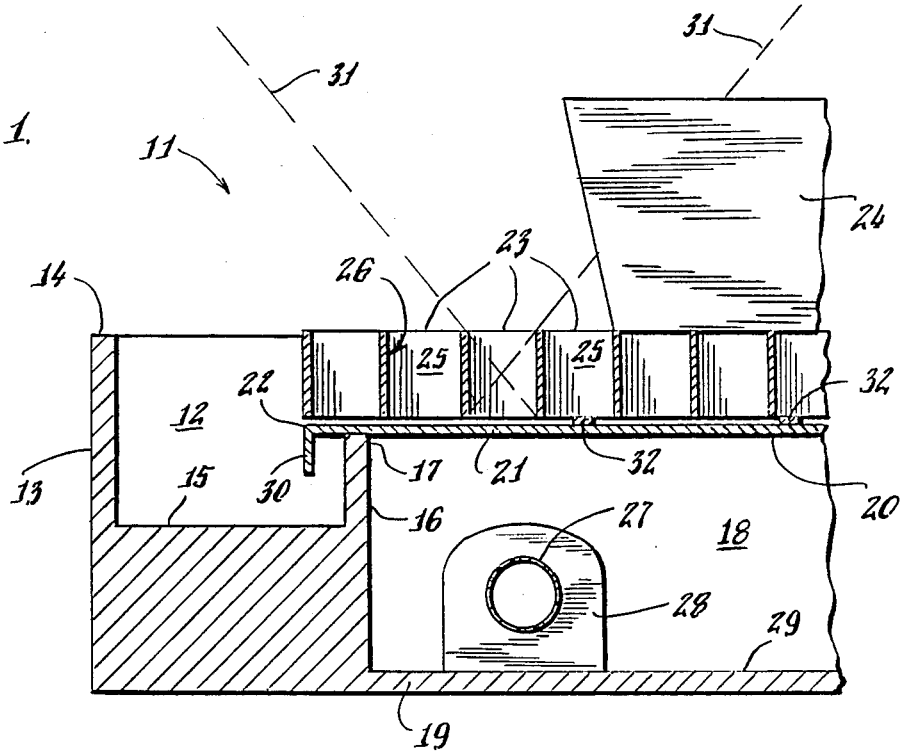
FIG. 1 is a diagrammatic, cross-sectional view of the apparatus used in the system.

FIG. 1 is a diagrammatic, cross-sectional view of the apparatus used in the system. Apparatus 11 includes a first receptacle 12 formed by outer wall 13, waterproof connecting bottom 15 and inner wall 16, said walls 13 and 16 forming a peripheral receptacle being of watertight construction and capable of serving as a water reservoir. Apparatus 11 also contains receptacle 18, which is an inner or central receptacle formed by wall 16, which completely surrounds receptacle 18 in a watertight manner, thus protecting the light source comprising lamp 27 and lamp holder 28 resting on waterproof bottom 19.

Rim 14 of light-impervious outer wall 13 extends above rim 17 of inner wall 16, preventing the lateral escape of light through wall 13. Waterproof lid 20 is positioned above receptacle 18 and may rest on rim 17 of inner wall 16. Lid 20 is provided with transparent portions 21 or may be totally transparent so as to permit light to escape upwardly from the light source in receptacle 18. Lid 20 comprises a rigid sheet having peripheral or outer edges 22 which jut out into the space above the first receptacle 12 and terminate above bottom of receptacle 12. Watertight lid 20 prevents water from reaching the light source or other members conducting electricity, such water running across the upper surface of lid 20 and falling to the bottom of receptacle 12. In a preferred embodiment of lid 20, a skirt or apron 30 is attached in a watertight manner to the peripheral edge 22 of lid 20, the edge of said skirt 30 extending downwardly toward bottom 15 of receptacle 12.

Resting on lid 20 is a structure comprising a plurality of grouped, hollow, vertically extending light and water conducting members 25. Said members are closely spaced, or abut each other. The conduiting members 25, in the embodiment shown, generally comprise means for reducing glare such that light generated at the light source in receptacle 18 is not directly visible to observers grouped around the apparatus 11. In the embodiment shown, the upper portions 26 of the inside walls of members 25 are light-absorbing or substantially non-reflecting. However, any suitable glare reducing system or structure can be provided. The upper edges 23 of members 25 are co-terminal and form a flat, perforate surface capable of supporting an object such as planter 24.

In order to reflect the maximum amount of light in an upwardly direction, the inner surface 29 of bottom 19 may be covered with a light-reflective substance or be of light-reflective material. Light escaping upwardly from receptacle 18 passes through the transparent portions of lid 20 and through the open members 25. Light rays passing upwardly through each of the members 25 form upwardly expanding light cones, one such cone being shown in dotted lines 31. Thus, the outer reaches of the object to be illuminated, such as a plant or a sculpture, will be struck by such light, but such light will not be directly visible to any observers positioned outside said light cones. The light cones emanating from each of members 25 collectively form a larger light cone having the combined light intensity of the individual light cones.

Water falling on the system as described, whether rain water, a fountain-like spray, or water resulting from an over-watering of a potted plant falls or runs through water and light conducting members 25 and runs across the upper surface of lid 20 until it is drained into receptacle 12. This combination of elements allows light to pass through the apparatus in an upwardly direction, while water passes through it downwardly and is collected in receptacle 12 connected to a suitable drain (not shown). Lamp 27, shown in FIG. 1 in diagrammatic fashion as a fluorescent tube is connected to a power source through appropriate wiring means (not shown). To facilitate drainage, a slight spacing is created between members 25 and lid 20, which is achieved by providing spacing means, such as legs 32, therebetween.

Figure 2:
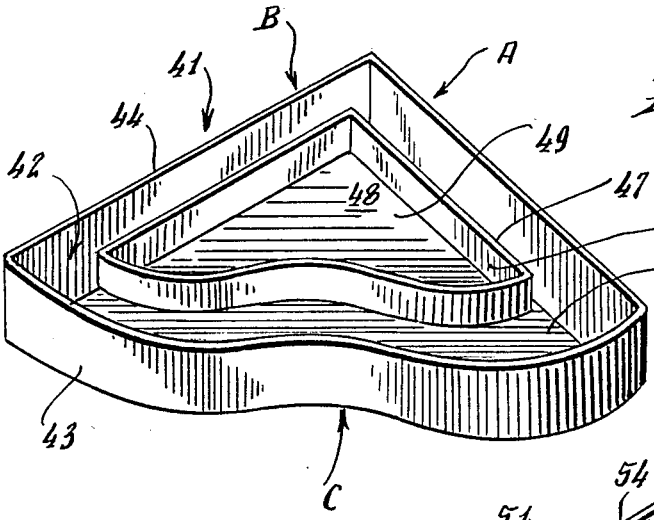
FIG. 2 is a diagrammatic, perspective view of an embodiment of the receptacles used in the system.

FIG. 2 is a diagrammatic, perspective view of an embodiment of the receptacles used in the system and particularly suitable for installation in a corner.

Sub-assembly 41 comprises a first, peripheral receptacle 42 and a second central receptacle 48. Receptacle 42 is formed by outer, light impervious wall 43, having upper rim 44 defining the perimeter of the sub-assembly, connecting bottom 45 and inner wall 46 having upper rim 47. Walls 43 and 46 are water impervious. Rim 44 extends vertically above rim 47, so that a waterproof lid (not shown), when placed on rim 47, does not protrude above rim 44. Inner or central receptacle 48 is formed by wall 46 and waterproof bottom 49 of receptacle 48, said receptacle 48 being adapted to contain a light source.

According to the configuration of the embodiment shown in FIG. 2 said outer wall 43 has three sides A, B and C. Sides A and B are straight and at their juncture form a 90° angle. The third side C has a free-form wall.

Figure 3:
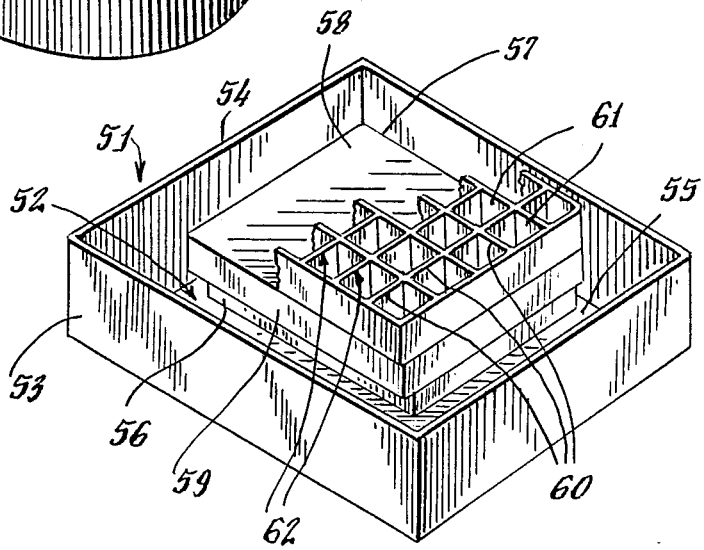
FIG. 3 is a diagrammatic, partially broken-away, perspective view of an embodiment of the receptacles, lid and perforate surface adapted to support an object to be illuminated.

FIG. 3 is a diagrammatic, partially broken-away, perspective view of an embodiment of a sub-assembly of the system, including receptacle walls, lid and perforate surface adapted to support an object to be illuminated. Said sub-assembly 41 comprises a first, peripheral receptacle 52, a second inner or central receptacle formed by wall 56, a transparent lid 57 and a table-like perforate surface 60 formed of individual hollow members 61.

First receptacle 52, open at the top, is formed by outer, light-impervious, waterproof wall 53 having upper rim 54, waterproof bottom 55 and inner watertight wall 56. Waterproof lid 57 rests on inner wall 56 and protrudes into the space above receptacle 52, but does not extend outwardly to contact wall 53. Lid 57 is formed of a transparent sheet or has transparent portions 58 permitting light shining upwardly from a light source (not shown) in the second receptacle formed by wall 56 and bottom 55 to pass through open members 61. Members 61 are hollow water and light conducting structures having co-terminal upper ends 60 forming a grid-like surface and non-reflective upper wall portions 62 preventing such surfaces from being visible. Transparent lid 57 has skirt 59 extending downwardly below the upper rim of wall 56, causing water falling through members 61 to run across lid 57 and collect in receptacle 52.

Figure 4:
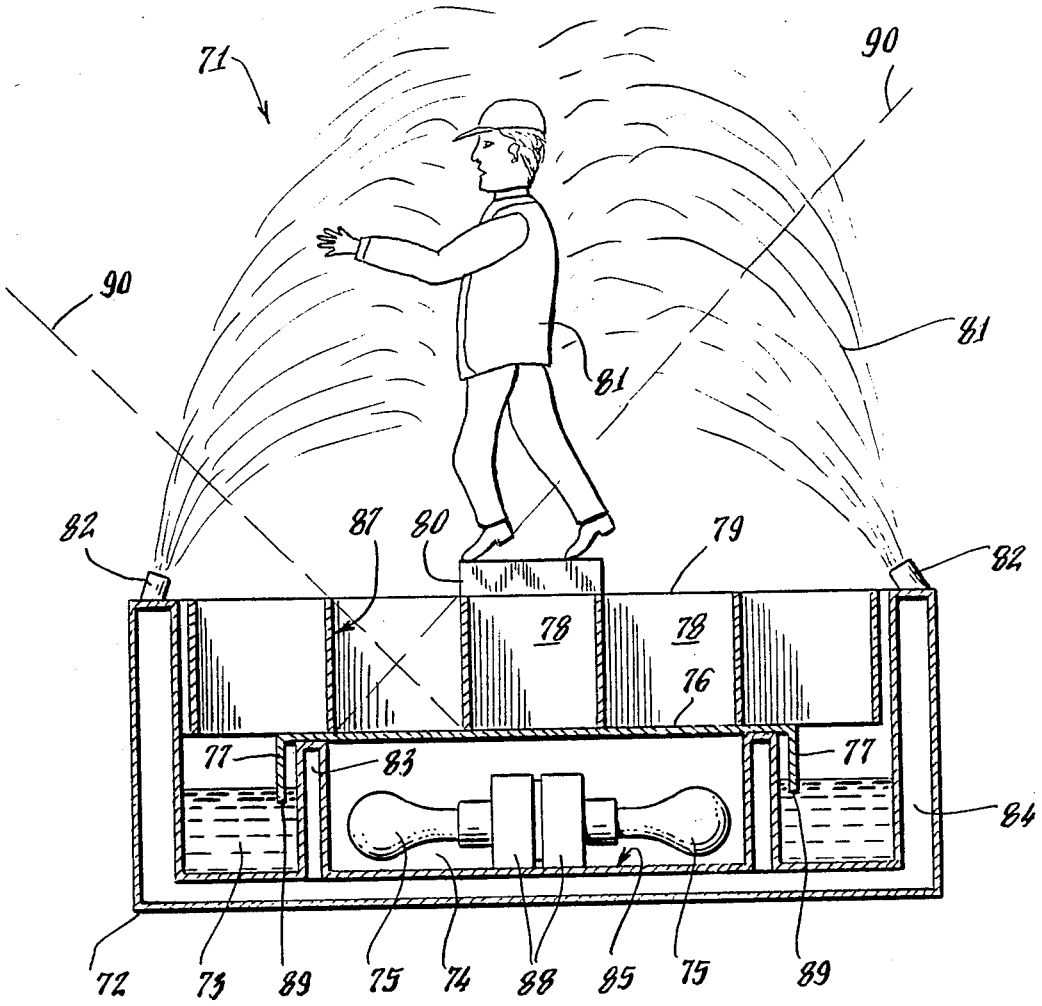
FIG. 4 is a diagrammatic, cross-sectional view of an embodiment of the system adapted to serve as an illuminated fountain.

FIG. 4 is a diagrammatic, cross-sectional view of an embodiment of the system adapted to serve as an illuminated fountain.

System 71 depicts the components of the system, except well-known water circulation means and supply means for electricity. The system includes a housing 72 which may be molded from plastic in one piece. Housing 72 includes outer reservoir 73 bounded by outer wall 84 and inner wall 83, inner light chamber 74 containing lamps 75 and lamp holders 88. The system 71 further includes waterproof, transparent lid 76 with skirt 77, hollow, light and water conducting members 78 forming a flat perforate surface 79, base 80 for sculpture 81 and water spray jets 82.

Waterproof lid 76 rests on the upper rim of inner wall 83, the edge 89 of its skirt 77 extending towards the bottom of reservoir 73. Members 78 form a structure presenting a table-like upper surface 79. Said structure rests on lid 76 which extends towards outer walls 84. Light projected upwardly by lamps 75 and light-reflective surface 85 passes through lid 76, through members 78 and strikes sculpture 81 and water spray 86. Said light emanating from light chamber 74 in the form of a plurality of light cones, one such cone being shown in dotted lines 90, will be visible to observers grouped around object 81 only by its reflections from said object 81 and spray 86. In order to further reduce any glare or glow from elements of the lighting apparatus, at least the upper portions of surfaces 87 of members 78 are made substantially nonreflective or given reflection reducing properties, such as a dark, dull coating.

Receptacle or reservoir 73 serves as a catch basin for rain water and as a re-circulation tank for spray water 86 falling on the apparatus. Customary pumping means are provided outside, but integrated into, the system.

The system has the advantage of a very short light path between the light source and the object to be illuminated, reducing lamp size, power requirements and the dimensions of the lighting apparatus. As will be noted, the components of the system are simple and easily assembled. The additional characteristic of the system of providing for the glare-free up-lighting of objects and the simulataneous drainage of falling water through the use of common components make the system highly cost-effective.

The embodiments of the invention described herein are intended to be illustrative of the principles of the invention and not limiting. Various modifications and other configurations and applications will occur to those skilled in the art. The scope of the present invention is indicated by the appended claims rather than by a foregoing description and any changes which come within the meaning and range of equivalency of the claims are intended to be embraced therein.

What is claimed is:

1. System for glare-free illumination in wet locations comprising a peripheral receptacle open at the top, formed by an outer, light-impervious wall having an upper rim, a connecting bottom and an inner wall having an upper rim, said first receptacle being adapted to contain water, a second inner receptacle being formed, at least partially, by said first receptacle inner wall and having an open top and a waterproof seal at said inner wall between said second receptacle and said first receptacle, said second receptacle being adapted to contain a light source, said first and second receptacles being located in substantially the same horizontal plane and having a substantially common bottom structure a waterproof lid covering said second receptacle, said lid comprising at least one transparent portion and having at least one portion peripherally extending into the space above the bottom of said first receptacle, a structure having a perforate surface disposed above said lid, said structure being formed by a frame having a plurality of grouped, hollow, vertically extending conduits with means for reducing glare from light generated in said second receptacle, an electric light source disposed in said second receptacle below said lid, and means to supply electricity to said light source, so that light generated in said second receptacle and shining upwardly through said lid and the members of said structure is not directly visible to observers grouped around said system, and so that water falling on said object and said system flows downwardly through said members and across the upper surface of said lid into said first receptacle without contacting the light source.

2. The system according to claim 1, wherein a light reflective surface has been provided in said second receptacle.

3. The system according to claim 1, wherein the peripheral portions of said lid are provided with skirts extending downwardly towards the bottom of said first receptacle.

4. The system according to claim 1, wherein said first receptacle has a three-sided outer wall comprising two straight sides forming a right-angle adapted to fit into a right-angled corner and a third free-form side.

5. The system according to claim 1, further comprising spray means disposed around an illuminated object supported by said surface, said spray means being adapted to be fed by liquid circulating means associated with said spray means, wherein said first receptacle is dimensioned so as to serve as a liquid recirculation reservoir to supply said spray means.

6. The system according to claim 1, wherein spacing means are provided between said lid and said water and light-conducting members.

7. A glare-free illumination fixture for use in a wet location comprising:

frame means having a bottom, a first outer peripheral wall and a second inner wall, said walls and said bottom forming a first outer receptacle having a substantially open top and being adapted to hold a supply of water, said second inner wall and said bottom forming a second inner receptacle having a substantially open top, being substantially surrounded by said first receptacle in a substantially common horizontal plane and being adapted to house an electric light source, said frame means comprising a substantially light-impervious material;

lid means adapted to cover said second receptacle and prevent water from flowing directly into said second receptacle, said lid means comprising means for transmitting light therethrough; and means for supporting an object to be illuminated on said lid means comprising a structure having a plurality of vertically oriented conduits, said conduits having means for reducing glare from light generated in said second receptacle such that glare of light passing through said lid means is not directly visible to observers, whereby said frame means and said supporting means can allow light generated in said second receptacle to shine upwardly through said lid means and through said vertically oriented conduits without having a source of the light being directly visible to observers and such that water falling on an object supported on said fixture can flow downwardly through said conduits, across said lid means and into said first receptacle without substantial risk of water entering said second receptacle.

* * * * *